US008833269B2

(12) United States Patent
Dawson et al.

(10) Patent No.: US 8,833,269 B2
(45) Date of Patent: Sep. 16, 2014

(54) TOP CHORD STIFFENER FOR ENCLOSED RAILCAR

(75) Inventors: Richard W. Dawson, Naperville, IL (US); Ronald P. Sellberg, Naperville, IL (US); Frank Andrew Nibouar, Chicago, IL (US)

(73) Assignee: TTX Company, Chicago, IL (US)

( * ) Notice: Subject to any disclaimer, the term of this patent is extended or adjusted under 35 U.S.C. 154(b) by 266 days.

(21) Appl. No.: 12/649,916

(22) Filed: Dec. 30, 2009

(65) Prior Publication Data

US 2010/0180516 A1 Jul. 22, 2010

Related U.S. Application Data

(63) Continuation-in-part of application No. 12/019,078, filed on Jan. 24, 2008, now Pat. No. 7,802,525, which is a continuation of application No. 11/079,662, filed on Mar. 14, 2005, now Pat. No. 7,401,559.

(60) Provisional application No. 60/554,804, filed on Mar. 19, 2004.

(51) Int. Cl.
*B61D 17/00* (2006.01)
*B61D 3/18* (2006.01)

(52) U.S. Cl.
CPC ..... *B61D 3/182* (2013.01); *B61D 17/00* (2013.01)
USPC ..... 105/404

(58) Field of Classification Search
USPC ..... 105/238.1, 355, 356, 377.1, 379, 380, 105/396, 404, 407, 409
See application file for complete search history.

(56) References Cited

U.S. PATENT DOCUMENTS

| | | | | |
|---|---|---|---|---|
| 2,181,583 | A * | 11/1939 | Gilpin | 105/404 |
| 2,412,283 | A * | 12/1946 | O'Connor | 52/56 |
| 2,842,074 | A * | 7/1958 | Hass et al. | 52/56 |
| 4,275,662 | A * | 6/1981 | Adler et al. | 105/377.01 |
| 6,237,505 | B1 * | 5/2001 | Sande et al. | 105/248 |
| 6,446,561 | B1 * | 9/2002 | Khattab | 105/355 |

* cited by examiner

*Primary Examiner* — R. J. McCarry, Jr.
(74) *Attorney, Agent, or Firm* — Brinks Gilson & Lione

(57) ABSTRACT

A superstructure for a railcar comprising at least a first side assembly, a roof extending from the first side assembly and being comprised of at least a first top chord extending inwardly and upwardly from the first side assembly and a first top chord stiffener comprised of at least a first leg and a second leg. The first and second legs are disposed at a right angle to each other, and the first top chord stiffener is attached to the first top chord and the first side assembly.

10 Claims, 9 Drawing Sheets

TOP CHORD STIFFENER FOR ENCLOSED RAILCAR

RELATED APPLICATIONS

The present patent application is a continuation-in-part application under 35 U.S.C. §120, and claims priority to U.S. patent application Ser. No. 12/019,078, filed on Jan. 24, 2008, and issued as U.S. Pat. No. 7,802,525, which in turn was a continuation of U.S. patent application Ser. No. 11/079,662, filed on Mar. 14, 2005, which issued as U.S. Pat. No. 7,401,559, which in turn claims the benefit of the filing date under 35 U.S.C. §119(e) of Provisional U.S. Patent Application Ser. No. 60/554,804, filed Mar. 19, 2004, all of which are hereby incorporated by reference.

BACKGROUND

Technical Field: Enclosed Railcars

The transportation of trucks, buses, large tractors and other large mobile freight by rail has created a demand for enclosed super size railcars, as most existing railcars do not have the appropriate internal dimensions to accommodate such large freight or are otherwise not able to enclose such freight. An enclosed railcar is preferred for transport because it minimizes exposure to the elements, vandalism and other general damage to the freight. Large enclosed railcars are presently used to transport automobiles and light trucks, several of which may be "stacked" vertically in the same multi-level railcar. The art discloses numerous ways of accomplishing the stacking of vehicles in a railcar by incorporating multiple decks, creating numerous levels so that the vehicles occupy space along the entire height of the car. The presence of intermediate decks in such large railcars, commonly called auto racks, obstructs the vertical height and horizontal width of the railcar interior so that individual, larger dimensioned vehicles, such as semi truck tractors, cannot fit or otherwise take advantage of these larger cars. Single level superstructure construction has been hindered by the need for alternate structural support, previously provided by intermediate decks or levels stabilizing the railcar to sufficiently sustain the bending load.

Construction of single level enclosed superstructure railcars has included manufacturing the entire railcar from scratch or alternatively converting an existing multi level super size railcar or other railcar by retrofitting it with a single level superstructure or shell, resulting in increased usable vertical height compared to that of the pre conversion railcar. Such conversion has often been limited, however, to applications of superstructures to existing multi level railcars or to railcar superstructures having widths commensurate with the width of the pre-conversion railcar.

Manufacturing single level enclosed railcars, like manufacturing most railcars, is very expensive and can be cost prohibitive. Construction or modification of a railcar must meet industry standards which dictate exterior dimensions and clearance, including the external width of the railcar relative to the length. There is a need in the industry to be able to economically manufacture an enclosed single level superstructure railcar having substantial unobstructed internal dimensions, both vertically and horizontally, while retaining structural stability.

BRIEF SUMMARY

The present invention is directed to a superstructure for a railcar comprising at least a first side assembly, a roof extending from the first side assembly and being comprised of at least a first top chord extending inwardly and upwardly from the first side assembly and a first top chord stiffener comprised of at least a first leg and a second leg. The first and second legs are disposed at a right angle to each other, and the first top chord stiffener is attached to the first top chord and the first side assembly.

DETAILED DESCRIPTION OF THE DRAWINGS AND THE PRESENTLY PREFERRED EMBODIMENTS

Figure 1:
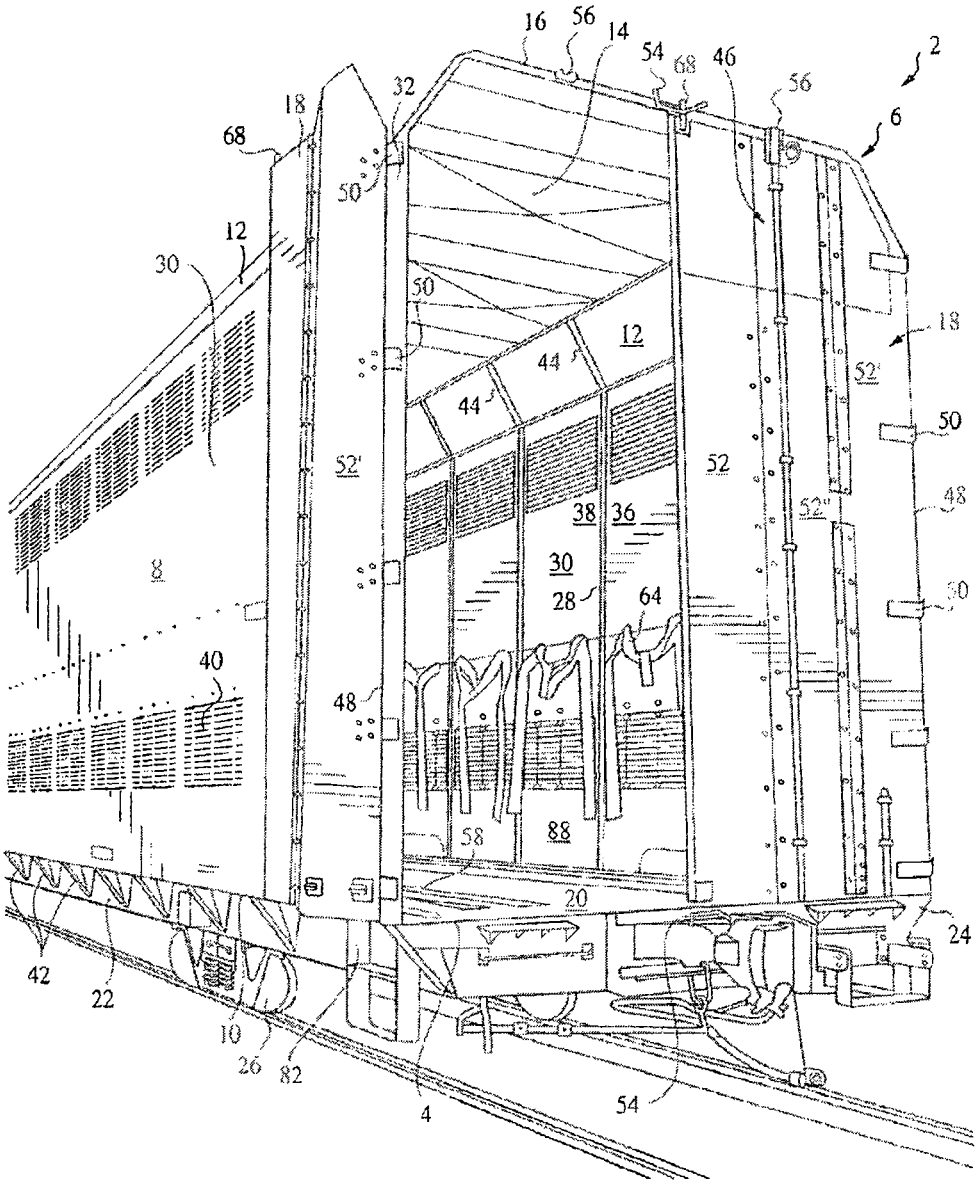
FIG. 1 is a perspective view of a converted enclosed railcar in accordance with the present invention having a superstructure with one door open.

The method detailed below and the unique resulting railcar allow maximum use of interior space of a widened railcar manufactured using an existing car body such that it can accommodate large freight, including Class 5 to Class 8 trucks, buses, tractors and other large freight. As shown in FIG. 1, the enclosed superstructure railcar 2 includes an existing railcar 4 and a superstructure 6, comprising side assemblies 8, a roof 14, door headers 16, and end doors 18. The side assemblies 8 of the superstructure 6 consist of side posts 28 and side sheets 30 which together form a continuous vertical sidewall, bottom side chords 10, and large top chords 12. The method of manufacturing the enclosed railcar is to shorten, lengthen or otherwise modify an existing railcar and attach a widened superstructure to the modified railcar. It is to be understood that descriptions of attaching, applying or joining railcar parts can be accomplished by welding, mechanical fasteners, or any other appropriate means of joining the railcar components. Most of the railcar components are manufactured from steel, various metals, alloys or other strong materials.

An existing railcar refers to railcars which were previously used or built for other purposes, and are taken out of such circulation and used in the present invention. Examples of existing railcars used in the railroad industry for various purposes and suitable for use in this invention include all purpose railcars, spine cars, hitch cars, boxcars, auto racks, gondola cars, log bunk cars, cover hopper cars, trailer cars, flat cars, standard level cars, or low level cars, among others. The railcar 4 is preferably a flat car and more specifically is preferably a standard level flush-deck flat car such as the JTTX 89' General Service Standard Level Flatcar. The use of other types of railcars is within the scope of this invention, but may require additional work to prepare for application of a superstructure. Due to their abundance, multi-level auto rack railcars are a good source of existing railcars to be used in this invention. Auto rack railcars, or other railcars containing attached superstructures, are preferably modified by removing structures which extend, particularly vertically, from the bed of the railcar, including any sidewalls, roofs, end doors or other specialized structures such that the remaining structure has the general structure of a flat car. Additionally, previous modification of railcars, including multi level auto rack railcars, have sometimes required removal of sections of the railcar corners for attachment of the multi-level structure, in which case, the corners must be restored before the new superstructure is attached. Shortening or lengthening of the railcar may require reinforcing the remaining car body such that it again meets industry standards of strength, however the length of the railcar need not be modified to be within the scope of the invention.

In a preferred embodiment, the existing railcar is modified to a length of approximately eighty to eighty-five feet. Because industry standards dictate width to length relationships of railcars, the length of the railcar and the width of the superstructure can be varied depending on the dimensions desired. The preferred method, generally known in the art, is to shorten the railcar by removing a middle section, approximately 5 to 10 feet in length and then carefully welding the two portions of the railcar back together; or alternatively to lengthen the railcar by adding sections to the middle of an existing railcar.

The alterations to an existing railcar preferably produce a modified railcar 4 with a car deck 20, two side sills 22, two end sills 24, a center sill and other underframe components (not shown) and at least two trucks 26 or sets of wheels. Reinforcement of the car body may be necessary to meet industry standards. In a preferred embodiment, the car deck is approximately five sixteenths of an inch (5/16") thick. The side sills 22, running the longitudinal length of the railcar, are preferably generally C-shaped, on top of which the car deck 20 is attached. The car deck 20 is generally rectangular and can align either flush with or offset inwardly from the edge of the side sills 22. Once the existing railcar 4 has been appropriately modified, the superstructure 6 can be added to the railcar.

Figure 4:
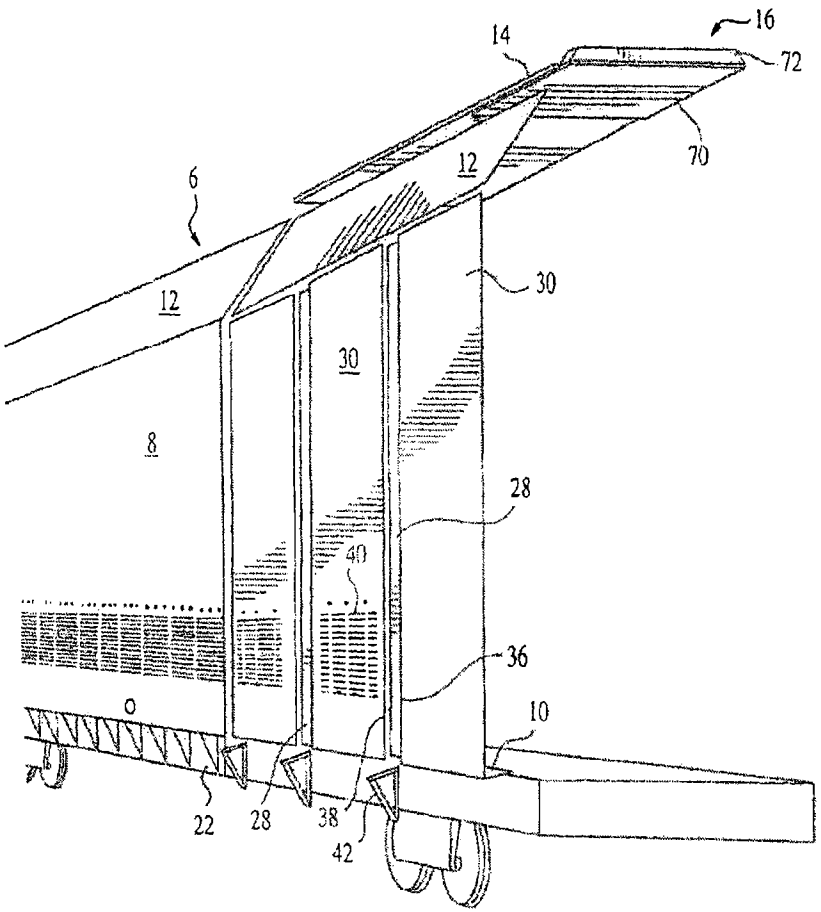
FIG. 4 is a cut-away drawing of parts making up the superstructure.

There are several portions of the superstructure that can be manufactured separately and assembled in numerous sequences to create the side assembly 8, as shown in FIG. 4. Naively, bottom side chords 10 and top chords 12 are attached on either end of vertical side posts 28, creating a structural frame. Side sheets 30 are connected to and between adjacent side posts and are welded to the top chords 12 and bottom side chords 10, as well as the side posts 28.

The bottom side chord 10 is a generally angular structural portion, substantially the same length as the railcar deck 20, and is constructed from one or several pieces of strong material, preferably steel. The bottom side chord 10 is preferably attached running parallel to the railcar 4 so that it rests on top of the car deck 20 or it can rest on the top portion of the side sill 22 which is not occupied by the car deck, as previously described. The bottom side chord 10 extends outwardly from and hangs over the side sills 22, as shown in FIG. 4, until met on its opposite edge by the side posts 28 and side sheets 30. In a preferred embodiment, the bottom side chord has an extension portion connected at one side to the rail car and having a small vertical lip extending upwards at the opposite side. The area between where the bottom side chord 10 attaches to the car deck or side sills and where the bottom side chord meets the side posts 28 and side sheets 30 is an extension of the width of the railcar effectively creating a greater interior lateral dimension than previously present on the unmodified railcar.

The side posts 28 of the side assembly 8 are preferably rectangular hollow metal tubing. While side posts used in conventional enclosed superstructures are approximately four inches (4") by eight inches (8") in cross section, those used in the present invention are smaller in the approximate range of two inches (2") by three to four inches (3"-4"). In a preferred embodiment, the side posts 28 extend vertically approximately twelve feet (12') from the bottom side chords 10 and car deck 20. The height of the side posts can be varied based on desire or required industry standards. For example, side assemblies can be higher if low level car bodies are used or if the roof is designed for a higher clearance profile.

As shown in FIG. 1, corner posts 32, can be attached at the four corners of the car, and are preferably made of a stronger construction, such as the use of thicker steel than that used for the side posts. The remaining vertical side posts 28 can be uniformly distributed along the length of the side assembly 8. The number of side posts 28 used will depend on the length of the side assembly 8 or car deck 20. For example, in a preferred embodiment, an eighty-two foot (82') long modified railcar utilizes approximately twenty side posts and approximately two corner posts per side of the railcar.

Figure 2:
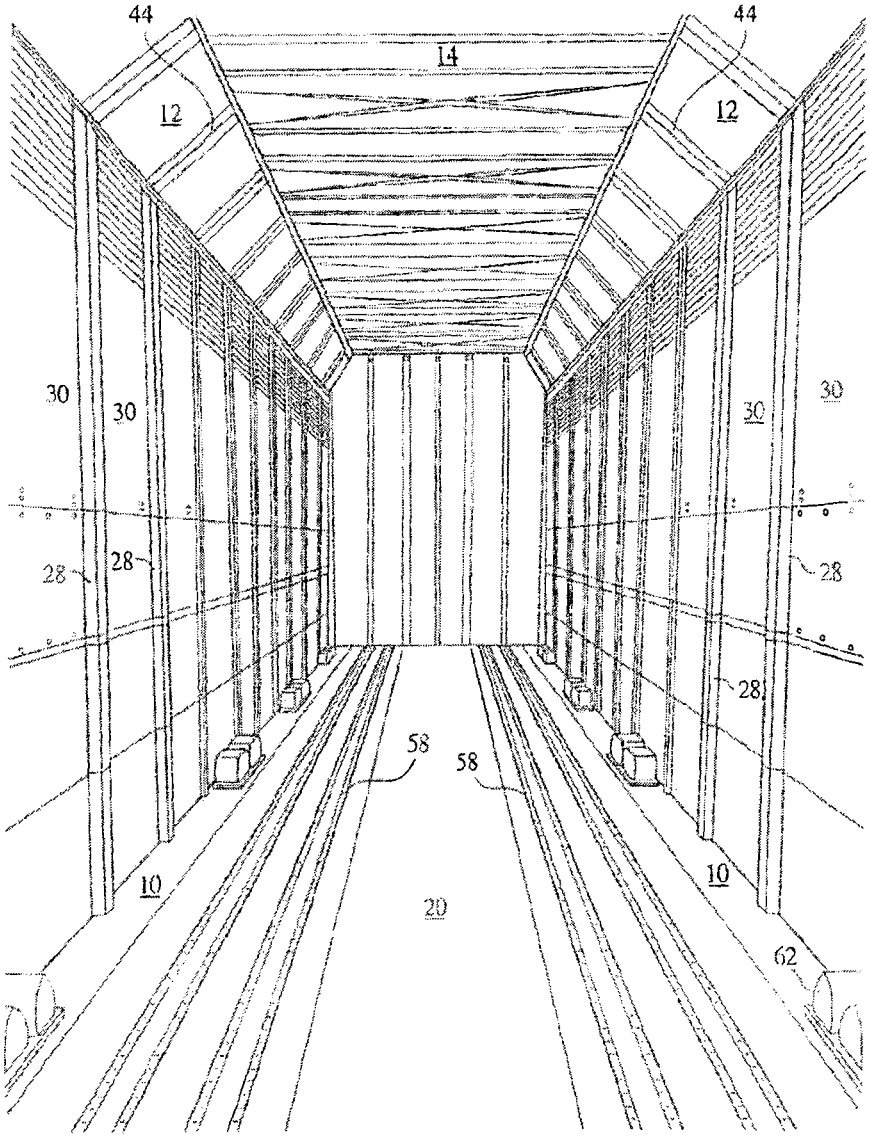
FIG. 2 is a perspective drawing of the interior of an embodiment of FIG. 1 showing the superstructure.
Figure 3:
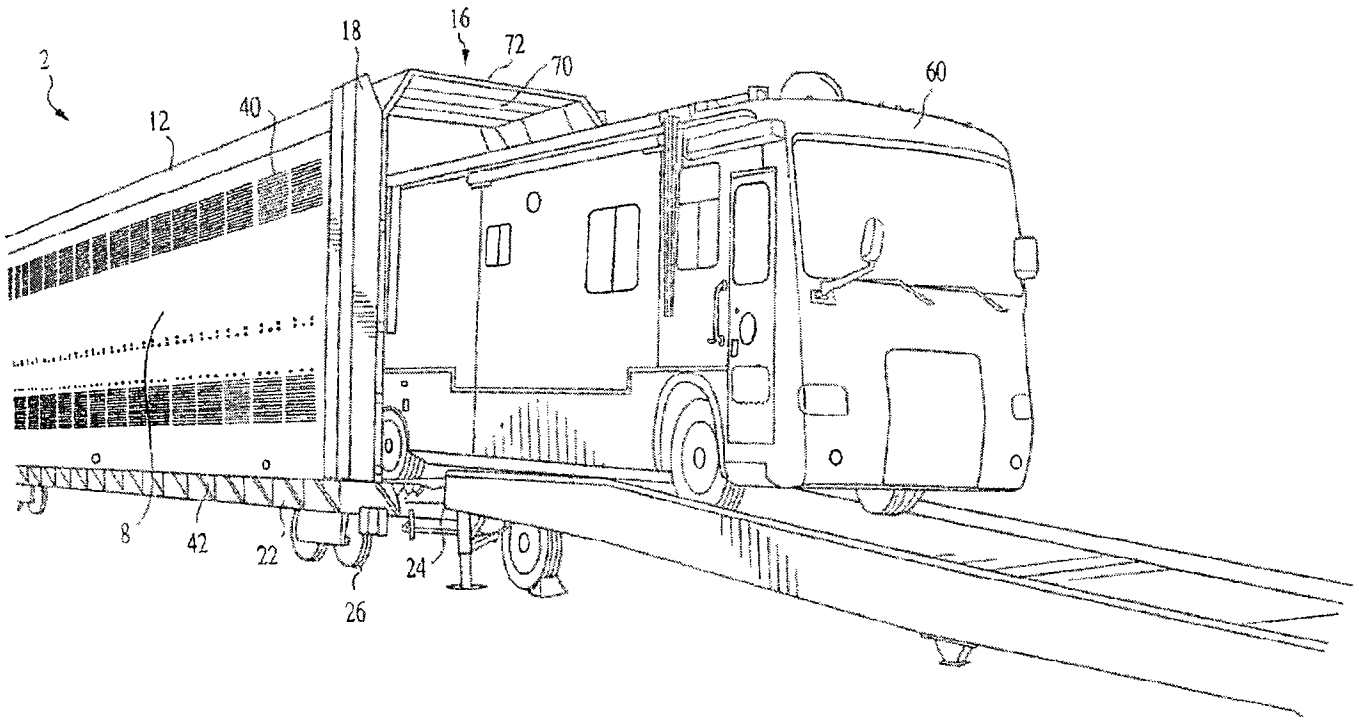
FIG. 3 is a perspective drawing of a large vehicle being unloaded from the superstructure of the enclosed railcar.

A plurality of side sheets 30 are preferably attached to the side posts 28 and to one another to create a continuous sidewall, as can be seen in FIGS. 1 and 2. The side sheets 30 are preferably also attached to both the bottom side chords 10 and the top chords 12, all together comprising the side assembly 8. The dimensions of the side sheets 30 are variable based on the length and height of the railcar and the spacing of the side posts 28 (or conversely the spacing of the side posts can be varied based on the dimensions of the side sheets). The side sheets preferably, have minimal depth while still being thick enough to absorb a portion of the bending load, preferably a depth of approximately one tenth of an inch (1/10") or less. In a preferred embodiment of the invention, the side sheets 30 are positioned such that the anterior vertical edge 36 of one side sheet meets flush with the posterior vertical edge 38 of the adjoining side sheet at a side post 28. In such a case, the side post 28 meets on the interior side of two side sheets 30 at the intersection, as shown in FIGS. 1 and 2. The flush vertical edges 36 and 38 of the adjoining portions of the side sheets are then attached, preferably by welding, to the side post 28 and to each other. The welding of the sheets to both the side posts and to each other allow for greater stability and strength of the side assembly 8.

Figure 5:
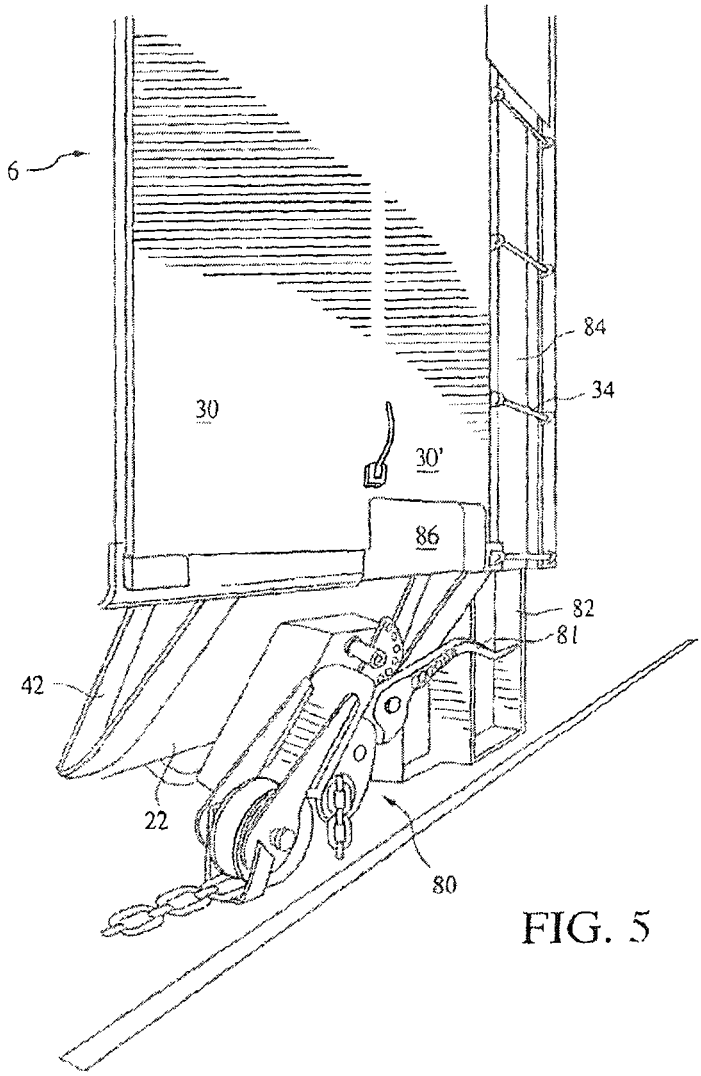
FIG. 5 is a perspective drawing of the exterior of the superstructure incorporating railcar accessories.

In a preferred embodiment, an end side sheet 84 can be attached between a corner post 32 and a side post 28 on the interior side of the superstructure 6, as shown in FIG. 5. While this may impose slightly on interior space, it does so minimally while allowing exterior clearance for railcar components such as sill steps and hand holds, as described below. Inset portions of side sheets can also be incorporated into the side assemblies to allow clearance for moving parts, such as hand brakes, also described below.

In an embodiment of the present invention, the use of smaller dimensioned posts, compared to conventional enclosed superstructures, is due in part to the construction of the side assemblies which can distribute the bending load onto both the side posts and the side sheets. Conventional side sheets are often surface covers, and do not contribute to supporting the bending load. As shown in FIGS. 1 and 4, small perforations 40 can be integrated into the side sheets 30 to allow light and air passage, while still minimizing damage and vandalism to the railcar freight.

The following dimensions are for a preferred embodiment and are only exemplary. The resulting distance between the most inner surfaces of the side posts 28 to those on the other side of the railcar is approximately ten feet, one and one-fourth inches (10'-1¼"). The distance between the interiors of the side sheets 30 on either side of the railcar (excluding the end side sheets and corner posts) is preferably only slightly wider at ten feet, five and one forth inches (10'-5¼"). In a preferred embodiment, the external width of the superstructure is approximately ten feet, five and a half inches (10'-5½"). In comparison, the pre modified car used in the preferred embodiment has a width of approximately nine feet (9'). Frequently in the art, the sides of an enclosing structure on a railcar are flush with the side sills of the railcar, but in this embodiment of the invention, width extension is possible due in part to the modification of the railcar such that industry standards allow a greater width, as well as the distribution of the load to the side assemblies.

As shown in FIGS. 1 and 4, a plurality of gussets 42, attached to both the side sills 22 of the railcar and to the underside of the bottom side chord 10, can be used to support and strengthen the side chords' lateral extension of the railcar. The gussets 42 preferably number that of the side posts 28 and are attached in general alignment with the side posts 28 to maximize support and strength. In a preferred embodiment, the gusset 42 is triangular, with one edge of the triangle welded to the side portion of the C shaped side sill 22 and an adjacent side of the triangular gusset also welded to the underside of the bottom side chord 10. The gussets 42, extending outwardly from the side sills 22, receive and support the bottom side chord 10. While the preferred embodiment uses triangular shaped gussets 42, any shape of gusset or other buttressing type support attached to the exterior of the car deck falls within the scope of this invention.

Modifying a railcar to receive a structure wider than the pre conversion railcar (preferably through the use of lateral extensions and supporting gussets) with shallow side walls (preferably due to a construction of shallow side posts 28 and relatively thin side sheets 30) results in a greater interior horizontal width than if the side sheets and regular sized side posts were attached flush with the side sills.

Large top chords 12 preferably extend from the top edge of the side sheets 30 and side posts 28 to provide further stability to the railcar 2. While conventional railcars utilize top chords that generally extend a few inches to 6 inches in height, the top chords of the preferred embodiment extend in a larger range of approximately one to two feet (1' to 2') in height. The top chord 12 can be made of one or several pieces of steel, and is generally an angular plane, preferably running approximately the length of the continuum of side sheets 30. The top chords 12 extend generally upwardly and inwardly from the side sheets. In a preferred embodiment shown in FIG. 4, the shape of the top chord includes a short vertical flange which attaches to the side sheets, a large angled portion extending the height of the railcar and a horizontal flange, extending inwardly from the angled portion, which attaches to the roof. The angled portion is the section which is larger and generally longer than in conventional top chords: at least six inches long versus the angled portion of a conventional top chord only being a few inches long. Top chord stiffeners 44, similar in construction to the side posts 28, are preferably attached to the top chords 12 similar to and preferably in alignment with the side posts 28. The top chord stiffeners 44 are also preferably attached to the aligned side posts 28. The top chord stiffeners 44 can be made from the same hollow rectangular tubing used for the side posts 28 or from tubing with numerous other shapes or profiles that stiffen the top chord. The top chord stiffeners 44 preferably provide support to the top chord 12, keeping it from buckling and helping to distribute weight to the side sheets and side posts. A top chord larger than that usually used, maximizes interior space because it intrudes less, and provides more useable interior area. The use of larger top chords can be a means of adapting the construction of the superstructure to further maximize the interior dimensions, based on existing clearance profiles.

Figure 8:
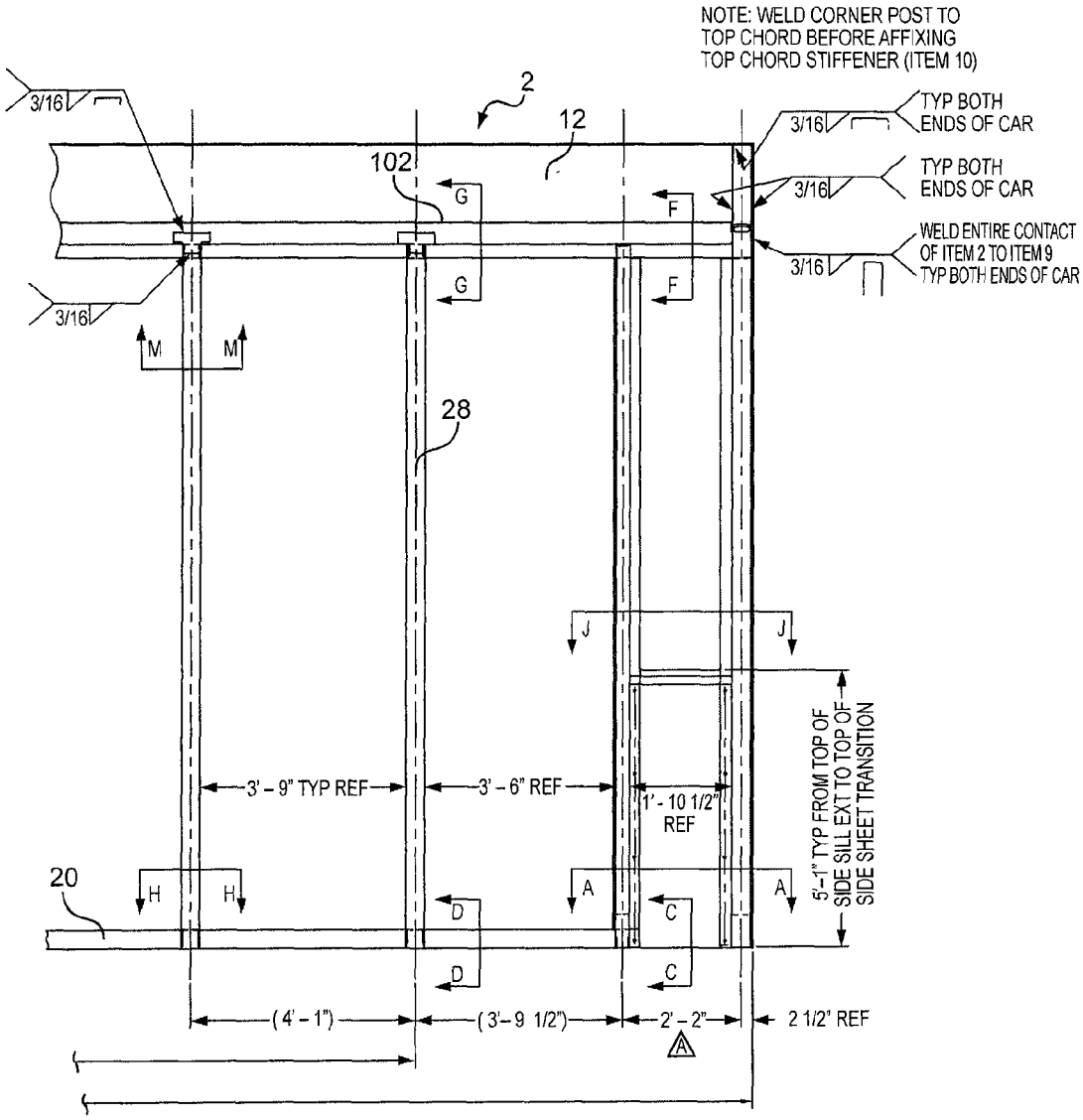
FIG. 8 is a side schematic view of the superstructure of FIG. 2.
Figure 10:
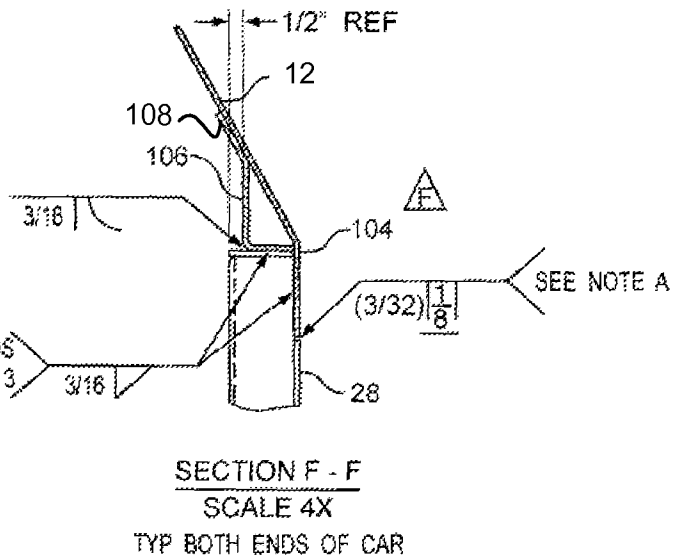
FIG. 10 is a cross-sectional view along line G-G of FIG. 8.
Figure 9:
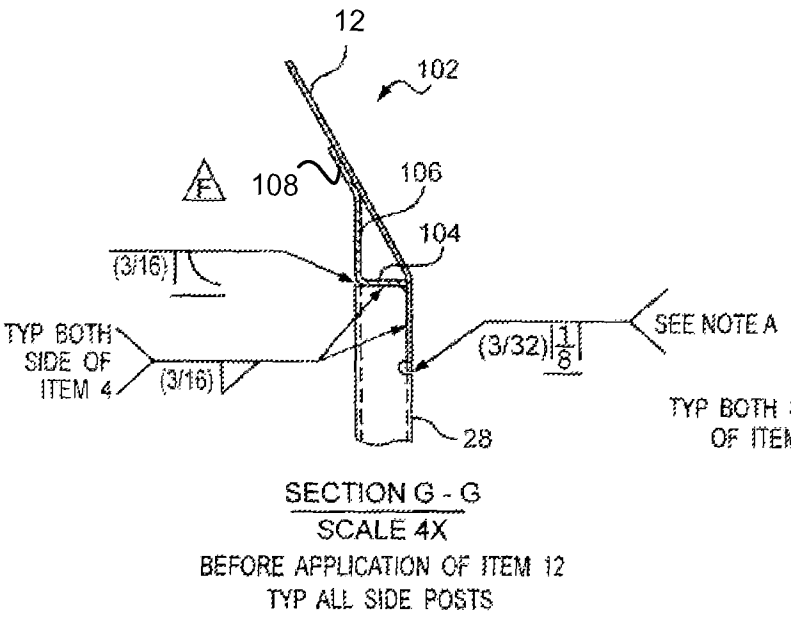
FIG. 9 is a cross-sectional view along line F-F of FIG. 8.

An alternative embodiment of the top chord stiffeners 44 is shown in FIGS. 8-10. FIG. 8 shows a schematic side view of FIG. 2 and FIGS. 9 and 10 show cross sectional views along lines G-G and F-F of FIG. 8 respectively. In this alternative embodiment, the top chord stiffeners 44 are replaced with a generally L-shaped support 102 forming what is referred to as a "box" shaped stiffener. A generally L-shaped support 102 is positioned on each side of the railcar 2 and each generally L-shaped support 102 preferably extends the length of the railcar 2. Each generally L-shaped support has a first leg 104 which is preferably parallel to the floor 20 of the railcar 2. Extending from the first leg 104 at a right angle is a second leg 106. The second leg 106 is preferably parallel to the side sheets 30. A third leg 108 extends from the second leg 106 at an obtuse angle. The angle of the third leg 108 as compared to the second leg 106 is preferably generally equal to the angle of the top chords 12 with respect to the side assembly 8 and/or the side posts 28.

This embodiment of the top chord stiffener 44 is preferably welded to the side posts 28 and the longitudinal top edges of the side sheets 30 along the first leg 104 of the top chord stiffener 44. The third leg 108 is in turn welded to the interior of the top chord 12.

The top chords 12 of the railcar, preferably attached along the longitudinal top edges of the side sheets 30, can be joined by a generally rectangular roof 14. In the preferred embodiment, the roof 14 is approximately eight feet, two inches (8'-2") wide and can be constructed from standard box car roof sheets. In a preferred embodiment, the roof 14 is generally parallel to the car deck 20. Standard box car roofs are typically made of galvanized steel, however other roof materials and designs are within the scope of the invention and can be used to connect the two top chords, provide weather protection and can act as a structural component. The length of the roof 14 is preferably slightly less than the longitudinal dimensions of the top chords 12 and railcar deck 20 to accommodate door headers 16, as described below. The roof can incorporate other features such as constructing it to be water tight or allowing light into the interior of the superstructure, if desired.

As shown in FIG. 4, door headers 16 are preferably comprised of two portions, namely a generally flat door header sheet 70 attached to a generally rectangular or trapezoidal beam 72. The door header sheet 70 is butted up against the top chords 12, preferably the horizontal portion or flange, and extends partially under the roof 14. The longer top chords 12 preferably keep the roof 14 and door header sheet 70 from interfering with the interior of the superstructure. The beam 72 is preferably smaller in length than the rectangular sheet and is attached parallel to the end sills 24. In a preferred embodiment, the beam 72 is attached to the door header sheet 70 and the top chords 12 such that the far edges of the beam 72 are flush with the adjacent top chord 12 and the front side of the beam is flush with the plane of the end sill, squarely capping off the two side assemblies. In a preferred embodiment, the door header sheet 70 is approximately eight feet (8')

wide and four to six inches (4" to 6") long, and the beam 72 is approximately eight feet (8') wide and two to three inches (2" to 3") long.

The two side assemblies 8 of the superstructure 6, in addition to being joined together and secured by the roof 14, can also be stabilized at their ends by the door headers 16. The use of door headers 16 provides lateral support to the superstructure shape, eliminating the need for intermediate decks as support, and provides for the exterior placement of a portion of the door locking system 46, as further described below, such that no interior space is occupied by the latching of the end doors 18.

Figure 6:
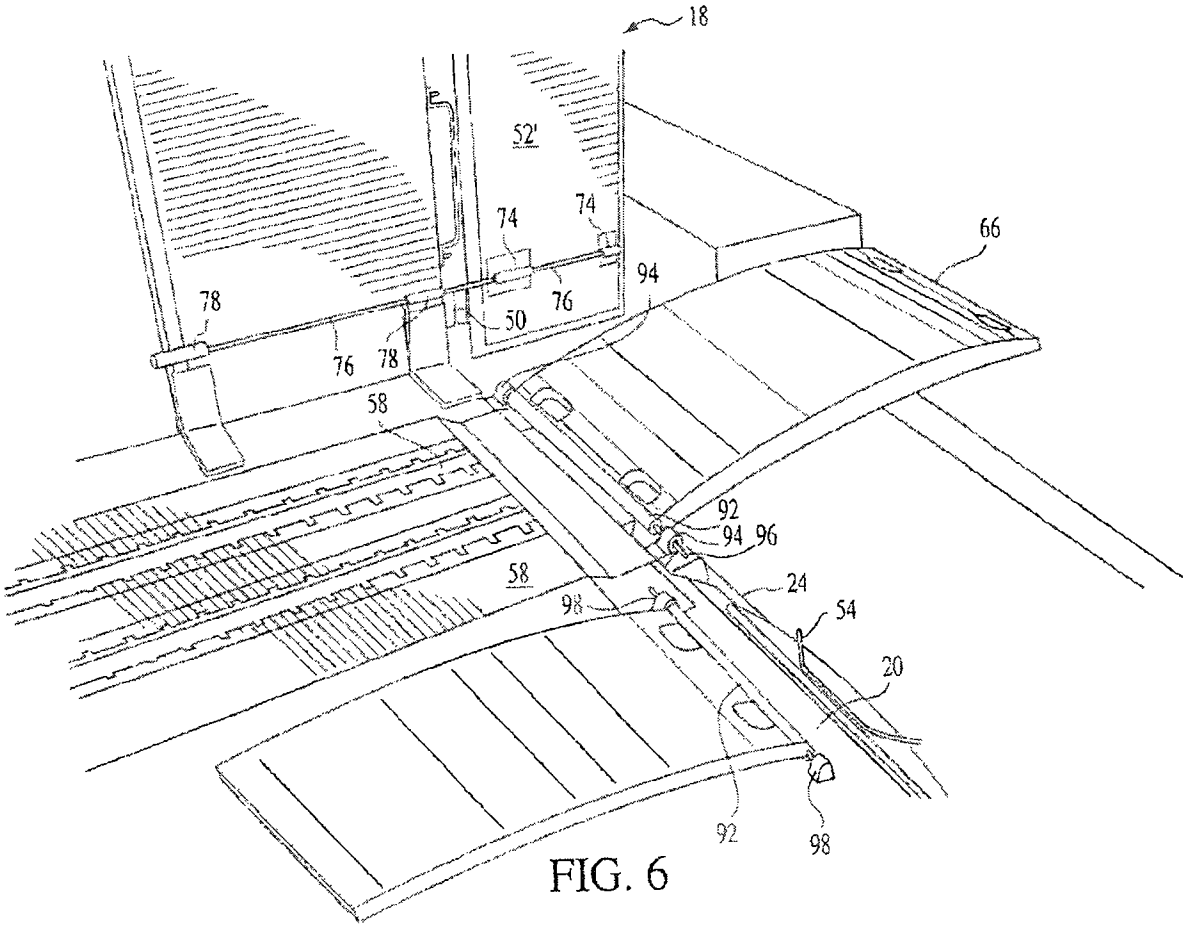
FIG. 6 is a perspective drawing of a bridge plate in use and in a storage position in the interior of an embodiment of FIG. 1 showing the superstructure.
Figure 7:
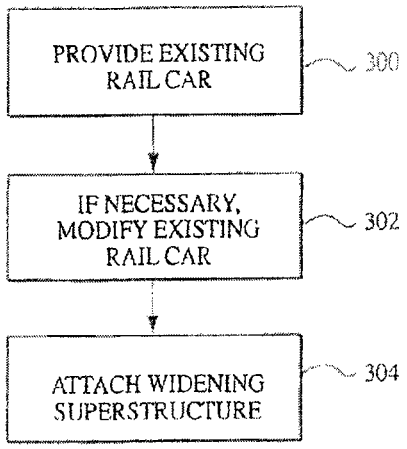
FIG. 7 is a drawing of a flow chart of the steps in manufacturing an enclosed railcar.

Multi fold doors are preferably used as they easily fold back and away with little clearance necessary and do not obstruct the entrance to the interior of the superstructure. As shown in FIGS. 1 and 6, multi-fold end doors 18 are attached at the ends of the superstructure 6. In a preferred embodiment, a set of two tri-fold door are used at each end, each door having three panels 52 joined together along their lateral ends by panel hinges. The posterior edges 48 of the doors 18 are preferably hinged to the corresponding corner post 32 using external hinges 50. The multi-fold externally hinged doors allow access to the interior of the superstructure without the obstructions usually seen with radial doors, which can obstruct the clear inside width, or single panel doors, which often need substantial space past the end sill to open. The use of external hinges 50 likewise decreases obstruction to the interior of the superstructure because the hinges 50 themselves do not intrude into the car and because the doors 18 can be rotated further laterally due to their rotational axis being on the outside of the structure. The doors can be compactly opened up and pushed out of the way during loading and unloading and preferably can be done so regardless of the dock/ramp height since the folded length is shorter than the coupler extending out past the end of the car. Preferably, a set of two multi-fold doors are used at each end of the superstructure.

In a preferred embodiment of the invention, the door panels 52 are constructed of a relatively thin material, of either a single or multiple layers. In a preferred embodiment, the multi-layer thin door panel is constructed of a hard foamed plastic core laminated between two sheets of thin steel. Other core materials for a multi layer panel could include other hard plastics, wood, aluminum plate, strand board, honey combed materials or any other rigid material. As an example, the preferred embodiment includes door panels having two layers of steel, each approximately 0.019 inches thick, with the entire panel only measuring approximately half an inch (½") thick. An example of a commercially available multi layer material is Duraplate™. The attachment of thinner doors to the superstructure, in turn, optimizes the longitudinal loading space of the railcar as that space is not consumed by the intrusion of the thickness of the door. Furthermore, the lighter doors can be opened by one person, preferably not requiring more than sixty pounds of force.

In a preferred embodiment, several steps work together to result in maximum internal capacity. Namely, the use of thin multi-fold doors produces a superstructure interior length that is no more than six inches (6") less than the length of the entire car body measured over the strikers; the use of large thin top chords, shallow side posts, and load absorbing side sheets, allows a lateral interior width that is only five feet (5') narrower than the exterior width of the side assemblies; and the construction of the side assembly as a whole and the manner in which it distributes load allows for an overall height of the door opening, in a preferred embodiment, of approximately fourteen feet, eight inches (14'-8"). These dimensions are to be used as an example and to show relative differences between pre- and post-modification and general ratios of construction and should not be thought to limit the scope of the invention. The use of a low level car type, the use of different clearance profiles, or other car types may change the door opening height and width.

Several other steps can be taken to produce a superstructure with optimized interior space. A multipoint door locking hardware system 46, using full length and partial length locking devices and shown in FIG. 1, are preferably mounted to the exterior of the door panels 52, maximizing inside length. In a preferred embodiment, the multi-point door locking system is a tube and cam type system. The primary door locking hardware used to secure the doors in their closed position can be received by a lock receiver or keeper 56 attached to the exterior of the door header 16. The keeper 56 is preferably shallower in height than the door header 16 to which it is mounted, and both the keeper 56 and the header 16, are shallower in height than the thickness of the roof 14. Because the door mounted door locking hardware 46 can be received and engaged in the keepers, which are mounted within the thickness of the roof, vertical interior height is optimized. The primary door locking hardware is preferably secured into the keepers 56 mounted on the exterior of either or both of the door header 16 and end sill 24. Generally, the outer surface of the door, the door header 16, and end sill 24 are all aligned in the same plane when the doors 18, are in their closed position. The primary locking hardware preferably can be pushed or pulled into or out of the keeper 56 by way of the locking system's handles. All of these portions of the locking system 46 are preferably located on the exterior of the doors to conserve space which would be taken up if mounted such that the keepers were located under the door header, requiring the doors to extend deeper into the superstructure interior, or if the locking hardware were mounted on the inside surface of the door panel, reducing interior height and length.

In a preferred embodiment shown in FIG. 6, the multi-fold end doors 18 can be opened accordion style and locked in place generally parallel to the side sheets 30. This can be accomplished by receiving brackets 74 mounted towards the bottom of the inside of the outboard door panel 52', which is the closest door panel to the corner posts, such that a rod 76 passed through these brackets, as well as similar interior brackets 78 aligned on the interior of the side assemblies 8, rigidly fixes the end door 18 in place. This arrangement allows unobstructed access to the interior. While some space is occupied by the receiving brackets 74 and the interior brackets 78 on the door and on the inside of the superstructure, they are preferably located low on the side assembly 8 and doors 52' where maximum clearance is not as vital and they do not extend as far into the interior as other car features like the chocks in their stored position, as described below. The locked accordion position additionally keeps the doors from swinging wide and allows access to the hand brake 80 located on the exterior of the side assembly 8, while the doors are still open. Alternately, the door 18 could be pivoted around the hinges 50 to be adjacent to the exterior of the side sheets 30.

The preferred locking hardware system 46 can also properly align the door in a planar position, as if it were a single panel door, when closed. The ability to lock the multi fold doors 18 in a planar fashion lends structure and support to the rear frame when the doors are in their closed position, while reducing the chances of racking and/or movement due to slack or rotation around the hinges. In a preferred embodiment, the primary lock is located on the center panel 52" of the door 18, with secondary locking means on the inboard panel 52 and outboard panel 52'. Gathering blocks or guides can be used to accomplish both a planar orientation of the door and to secure the posterior door panels to the superstructure or railcar. As an example, a gathering guide 54 can be mounted to the approximate center of the door header to catch and receive a pin 68 mounted to the exterior of the inboard panel 52 and extending vertically upward from the top of the panel such that it can be caught by the guide, ensuring that the last panel of the door is flat against the superstructure. Additional pins can be mounted on the exterior of the panels and extend vertically downward from the bottom of the door to be received in guide 54 or other receiving means on the end sill 24. Additional blocks can be placed on the outboard side of the keepers to prevent the locking door hardware from not engaging in the keepers properly, while the door locking handles are rotated into their locked position. This feature preferably prevents the door locking handles from being positioned in the locked position, without the hardware being properly engaged in the keepers.

To further conserve space, required equipment such as hand brakes 80, hand holds 34, and sill steps 82 can preferably be arranged or attached to not impose upon the interior space while maintaining operational clearances, as shown in FIG. 5. This can be done, for example by attaching such devices to the side sill 22 which is set inwardly from the plane of the side sheets 30, rather than to the superstructure 6 itself, which causes external clearance problems or necessitates impinging on the interior space. Placing a hand brake on the side sills of railcars which have not been extended horizontally would not conserve space since it would still increase the exterior dimensions of the car. Additionally, an inset portion 84 of the side assembly, formed by attaching a side sheet between the corner post and the first side post on the interior of the superstructure, as opposed to the exterior, allows for placement of the sill step 82 and hand holds 34 such that they are within operational clearance and do not significantly extend past the plane of the side assemblies 8. Similarly, a cut out 86 can also be built into a side sheet 30' aligned with the hand brake 80 such that the handle 81 of the hand brake is allowed to fully rotate upwards with sufficient hand clearance and does so without extending significantly past the plane of the continuous side sheets. The cut out 86 can be accomplished by dividing an individual side sheet's 30 attachment to the side posts 28 partially on the exterior and partially on the interior of the superstructure 6 with any resulting gaps enclosed with similar material. Again, while the cut out 86 slightly intrudes on the interior of the superstructure, it does so adjacent to the already inset panel 84 and at a low height where clearance is not as vital.

Several features within the superstructure interior can be used in properly securing, loading or unloading the freight. The interior of the superstructure 6 preferably includes at least one set of tire guide tracks or tie down tracks 58 attached to and extending longitudinally along the car deck 20. The tie down tracks 58 and associated chocks and harnesses are used to help guide, position and secure the truck or other large freight 60 being placed in the railcar. Chocks 62 can be engaged to the tie down tracks 58 in front of and behind the wheels of the vehicle to diminish shifting of the freight. The chocks 62 are stored in brackets at the extreme sides of the interior when not in use to limit consumption of interior space, as shown in FIG. 2. As previously mentioned, the interior space taken up by the chocks is towards the bottom of the superstructure interior where clearance is not as vital. An example of commercially available chocks is the Winchock™.

Vehicle door edge protection is preferably provided by protection sheets 88 which are a thin plastic or other soft or resilient material attached longitudinally along the interior of the side assembly 8. An example of commercially available material for vehicle door-edge protection sheets is Zefreck's EdgeGard™. Preferably, the generally translucent protection sheets 88 are positioned across a lower row of perforations 40 which reduces the influx of dust and debris but still allows light in. The row of perforations closer to the top of the railcar preferably allow for ventilation. The protection sheets 88 prevent damage to the freight, such as vehicle doors opened during loading or unloading. As shown in FIG. 1, fabric harnesses 64 used in securing the freight can be stored, when not in use, by hanging them from brackets located along the interior of the side sheets 30. Hanging the fabric harnesses in such a manner allows them to be readily available while taking up an insignificant amount of the superstructure interior.

Portable bridge plates 66, used in loading and unloading the vehicles, can be stored inside the railcar when not in use. Bridge plates are generally used to span the distance between two coupled railcars or between the end of the railcar and the surface onto which the vehicles are being unloaded, by accommodating and supporting the wheels of the vehicle. Bridge plates 66, shown in FIG. 6, are preferably slightly arched rectangular sheets of steel with tubular channels 92 running laterally along the ends of the plates. Generally, two bridge plates 66 are aligned with the tie down tracks and should be of sufficient width to accommodate the wheels of either small or large vehicles. The railcars of the present invention can be configured to allow for circus loading where multiple railcars are positioned together, with the doors at both ends of all cars open and the bridge plates installed between the railcars. Vehicles can then be loaded and unloaded, through multiple cars. Generally, this type of loading or unloading operation greatly reduces the time to complete a loading or unloading operation.

As shown in FIG. 6, when the bridge plates 66 are in use, the tubular channel 92 of the bridge plate is aligned with at least two end sill collars 94 which preferably align on either side of the tubular channel 92 of the bridge plate. A bridge plate rod 96 is preferably inserted through one end sill collar 94, continues through the tubular channel 92 and goes through another end sill collar 94, to secure the bridge plate 66 to the end sill 24 of the railcar. Storage of the bridge plates when not in use has previously been cumbersome or difficult. In a preferred embodiment, the bridge plate is generally narrower than the distance between the innermost tie down tracks 58 on the car deck 20. As shown in FIG. 6, the bridge plates can be slid between the tie down tracks 58 and secured in the stored position by aligning the tubular channel 92 with car deck collars 98, which are generally similar in shape to the end sill collars. When the bridge plate 66 is placed such that the tubular channel 92 is aligned with and between at least two car deck collars 98, the bridge plate rod 96 can similarly be inserted through the channel 92 and the car deck, collars 98, to secure the bridge plate during storage and create a useful place for the bridge plate rod 96. The bridge plates in a preferred embodiment are approximately five inches (5") tall, which is not substantially taller than the tie down tracks 58 which extend approximately three and a half inches (3½") from the car deck 20. The bridge plates 66 are preferably stored directly on the car deck where clearance requirements are not as stringent and they will not interfere with the freight or detrimentally decrease the interior door opening height.

Preferably two bridge plates can be stored by placing one on either end of the car bed between the tie down tracks, at the door openings.

The following is an example of the sequence by which an existing railcar can be prepared and the superstructure assembled and applied, although the sequence can be varied. The existing railcar can be prepared and the superstructure subassembled sequentially or simultaneously. Preferably, the modifications to the railcar should be essentially completed by the time the superstructure is applied to it. First, an engineering review is completed to determine the exact location where modifications to the existing railcar should be made. The review can include examining the modifications, such as cutting the railcar in two and removing a length of section, so that loss of structural integrity and required rework are minimized, and required reinforcements to ensure structural integrity are determined. Various processes and procedures can be used to select the appropriate car body to modify. After the appropriate car is selected and the engineer review is complete, an acetylene torch can by used to cut the car in the defined locations. After removing the required section, all metal edge conditions are properly prepared to insure adequate fit up and alignment. The two sections of the car body can then be aligned using fixtures to meet camber, truck center length, car length, and deck drop off requirements. Various welding and ultrasonic techniques are used to complete and inspect the welded assemblies. If the car is being lengthened rather than shortened, an additional underframe section is produced and inserted in the opening created. Appliances applied or modifications made for the railcar's previous use are removed as well as hand brakes, side handholds and sill steps. Components such as couplers, draft gears, brake valves, etc. are inspected and reconditioned or replaced as appropriate.

Next, the side posts, corner posts, bottom side chords and top side chords are connected together to form a frame, preferably by welding. The side sheets can then be applied to the resulting frame to form the side assemblies. The side assemblies can be applied to the railcar and the door headers applied to connect the side assemblies together at the ends. The roof, which may have been (but need not necessarily have been) subassembled previously, is applied to the side top chords and door headers.

Lastly, the following components may be applied to the car in almost any order: the gussets to the side sills and bottom side chords, the hand brake, the sill steps, the handholds, the doors and associated securement hardware, the tie down tracks, chocks, the door edge protection, the fabric tire harnesses, and the bridge plates. The completed car and superstructure can then be painted and the appropriate markings applied.

It is intended that the foregoing detailed description be regarded as Illustrative rather than limiting, and that it be understood that it is the following claims, including all equivalents, that are intended to define the spirit and scope of this invention.

The invention claimed is:

1. A superstructure for a railcar, said superstructure comprising:

at least a first side assembly comprising:

at least one vertical side sheet having an interior wall facing the interior of said superstructure, at least one vertical side post attached to said interior wall of said vertical side sheet, and at least one first top chord extending inwardly and upwardly from said at least one vertical side sheet and said at least one vertical side post;

a roof extending from said first side assembly; and a first top chord stiffener comprised of at least a first leg disposed parallel to a floor of said railcar, and a second leg disposed parallel to said vertical side sheet, said first and second legs being disposed at a right angle to each other, said second leg extending upwardly and vertically from said first leg, said first top chord stiffener being attached to said first top chord, said first side assembly, and said at least one vertical side post.

2. The superstructure of claim 1, wherein said first top chord stiffener further comprises a third leg extending from a distal end of said second leg and being attached to a surface of said first top chord.

3. The superstructure of claim 2, wherein said third leg extends at an obtuse angle from said second leg.

4. The superstructure of claim 1, further comprising:

a second side assembly comprising:

at least a second vertical side sheet having an interior wall facing the interior of said superstructure;

at least a second vertical side post attached to said interior wall of said second vertical side sheet of said second side assembly, and at least a second top chord extending inwardly and upwardly from said second vertical side sheet and said second vertical side post;

wherein said roof extends from said first and second side assemblies; and a second top chord stiffener comprised of at least a first leg disposed parallel to a floor of said railcar and a second leg, the second leg disposed parallel to said vertical side sheet, said first and second legs being disposed at a right angle to each other, said second leg extending upwardly and vertically from said first leg, said second top chord stiffener being attached to said second top chord, said second side assembly and said at least one vertical side post of said second side assembly.

5. The superstructure of claim 1, wherein said first top chord stiffener extends the length of said railcar.

6. The superstructure of claim 1, wherein said top chord stiffener and said first top chord together make a substantially triangular cross-sectional shape.

7. A superstructure for a railcar, said superstructure comprising:

at least a first side assembly comprising:

at least one vertical side sheet having an interior wall facing the interior of said superstructure, at least one vertical side post attached to said interior wall of said vertical side sheet, and at least one top chord extending inwardly and upwardly from said at least one vertical side sheet and said at least one vertical side post;

a roof extending from said first side assembly; and a top chord stiffener including:

a first leg welded to a top of the at least one vertical side post and attached to a second leg, said second leg extending upwardly and vertically from said first leg, and a third leg extending from a distal end of said second leg and being welded to an inside surface of said at least one top chord.

8. The superstructure of claim 7, wherein said third leg extends at an obtuse angle from said second leg.

9. The superstructure of claim 7, wherein said first leg and said second leg are disposed at right angles.

10. The superstructure of claim 7, wherein said top chord stiffener and said top chord together make a substantially triangular cross-sectional shape.

* * * * *

UNITED STATES PATENT AND TRADEMARK OFFICE

CERTIFICATE OF CORRECTION

PATENT NO. : 8,833,269 B2
APPLICATION NO. : 12/649916
DATED : September 16, 2014
INVENTOR(S) : Dawson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 354 days.

Signed and Sealed this
Eleventh Day of August, 2015

Michelle K. Lee

Michelle K. Lee
*Director of the United States Patent and Trademark Office*